US009140512B2

(12) United States Patent
Witchel

(10) Patent No.: US 9,140,512 B2
(45) Date of Patent: Sep. 22, 2015

(54) GUN RECOIL SUPPRESSOR AND METHOD OF USE

(71) Applicant: Jim Juel Witchel, Hurricane, UT (US)

(72) Inventor: Jim Juel Witchel, Hurricane, UT (US)

( * ) Notice: Subject to any disclaimer, the term of this patent is extended or adjusted under 35 U.S.C. 154(b) by 0 days.

(21) Appl. No.: 14/161,259

(22) Filed: Jan. 22, 2014

(65) Prior Publication Data

US 2014/0202057 A1 Jul. 24, 2014

Related U.S. Application Data

(60) Provisional application No. 61/755,187, filed on Jan. 22, 2013.

(51) Int. Cl.
*F41A 21/00* (2006.01)
*F41A 23/02* (2006.01)
*F41A 25/00* (2006.01)

(52) U.S. Cl.
CPC ..... *F41A 23/02* (2013.01); *F41A 25/00* (2013.01)

(58) Field of Classification Search
CPC ..... F41A 23/02; F41A 25/00
USPC ..... 42/1.06, 94; 89/37.04; 248/274; 73/11.04; 269/152
See application file for complete search history.

(56) References Cited

U.S. PATENT DOCUMENTS 1,457,407 A * 6/1923 Stokes ..... 89/37.04
2,352,870 A * 7/1944 Trotter ..... 89/37.03
2,378,545 A * 6/1945 Fraser et al. ..... 73/167
2,427,365 A * 9/1947 Meister ..... 269/152
2,582,140 A * 1/1952 Leek ..... 89/44.01
2,729,975 A * 1/1956 Hawthorne et al. ..... 73/167
2,731,829 A * 1/1956 Wigington et al. ..... 73/167
2,817,233 A * 12/1957 Dower et al. ..... 73/167
3,358,504 A * 12/1967 Freebairn ..... 73/167
3,805,608 A * 4/1974 Schmidt et al. ..... 73/167
4,055,017 A * 10/1977 Thompson ..... 42/94
4,449,314 A * 5/1984 Sorensen ..... 42/94
4,799,324 A * 1/1989 Nodo ..... 42/94
4,972,619 A * 11/1990 Eckert ..... 42/94
5,056,410 A * 10/1991 Pitts ..... 89/37.04
5,070,636 A * 12/1991 Mueller ..... 42/94
5,081,783 A * 1/1992 Jarvis ..... 42/94
5,272,955 A * 12/1993 Bond et al. ..... 89/37.04
5,419,233 A * 5/1995 Mulvaney ..... 89/37.04
5,628,135 A * 5/1997 Cady ..... 42/94
5,811,720 A * 9/1998 Quinnell et al. ..... 89/37.04
5,913,668 A * 6/1999 Messer ..... 42/94
7,047,863 B2 * 5/2006 Hawkes et al. ..... 89/37.04
7,086,192 B2 * 8/2006 Deros ..... 42/94
7,313,884 B2 * 1/2008 Eddins ..... 42/94
7,587,854 B2 * 9/2009 Werner ..... 42/94
7,823,318 B2 * 11/2010 Hall ..... 42/94
7,963,206 B2 * 6/2011 Bartle ..... 89/37.04
8,011,129 B2 * 9/2011 Cauley et al. ..... 42/94
8,109,028 B2 * 2/2012 Roberts et al. ..... 42/94
8,245,431 B2 * 8/2012 Werner ..... 42/94
8,245,432 B2 * 8/2012 Letson ..... 42/94
8,549,786 B1 * 10/2013 Griffith ..... 42/94

(Continued)

*Primary Examiner* — Michelle R Clement
(74) *Attorney, Agent, or Firm* — Gurr & Brande, PLLC; Robert A. Gurr

(57) ABSTRACT

In an embodiment of the present invention, a firearm recoil suppressor comprises a boot for receiving the butt-stock, at least one means for suppressing the recoil, a base, and a base fixture device. In one embodiment, the suppressing means comprises at least one hydraulic shock absorber, such as a piston and cylinder, or other shock absorber known to those with skill in the art.

10 Claims, 3 Drawing Sheets

(56) References Cited

U.S. PATENT DOCUMENTS

| | | | | |
|---|---|---|---|---|
| 2005/0000141 | A1* | 1/2005 | Cauley et al. | 42/94 |
| 2005/0066808 | A1* | 3/2005 | Hawkes et al. | 89/41.05 |
| 2006/0230664 | A1* | 10/2006 | Eddins | 42/94 |
| 2007/0051235 | A1* | 3/2007 | Hawkes et al. | 89/37.04 |
| 2007/0074439 | A2* | 4/2007 | Cauley et al. | 42/94 |
| 2007/0256346 | A1* | 11/2007 | Potterfield et al. | 42/94 |
| 2008/0134555 | A1* | 6/2008 | Werner | 42/69.01 |
| 2008/0209790 | A1* | 9/2008 | Bartle | 42/94 |
| 2009/0025267 | A1* | 1/2009 | Reinert et al. | 42/94 |
| 2009/0119967 | A1* | 5/2009 | Hall | 42/1.06 |
| 2009/0249675 | A1* | 10/2009 | Cauley | 42/94 |
| 2010/0012107 | A1* | 1/2010 | Bednar | 124/25 |
| 2010/0170128 | A1* | 7/2010 | Werner | 42/1.06 |
| 2010/0236125 | A1* | 9/2010 | Morrow et al. | 42/94 |
| 2011/0010980 | A1* | 1/2011 | Potterfield et al. | 42/94 |
| 2011/0048124 | A1* | 3/2011 | Durham et al. | 73/167 |
| 2011/0094140 | A1* | 4/2011 | Letson | 42/94 |
| 2011/0197748 | A1* | 8/2011 | Roberts et al. | 89/37.04 |
| 2012/0011759 | A1* | 1/2012 | Cauley et al. | 42/94 |
| 2012/0174461 | A1* | 7/2012 | Potterfield et al. | 42/94 |
| 2012/0180643 | A1* | 7/2012 | Woods | 89/37.04 |
| 2012/0186125 | A1* | 7/2012 | Werner | 42/94 |
| 2012/0222344 | A1* | 9/2012 | Werner | 42/94 |
| 2012/0285062 | A1* | 11/2012 | Cama | 42/1.06 |
| 2014/0237882 | A1* | 8/2014 | Banes et al. | 42/94 |

* cited by examiner

GUN RECOIL SUPPRESSOR AND METHOD OF USE

CROSS-REFERENCE TO RELATED APPLICATIONS

This application claims the benefit of U.S. Provisional Application Ser. No. 61/755,187, filed on Jan. 22, 2013, which is incorporated herein by reference.

TECHNICAL FIELD

The present invention relates to firearms. More particularly, the present invention relates to methods and devices for suppressing the recoil of rifles, shotguns, pistols, and other firearms.

BACKGROUND

A common problem when using a firearm is the recoil, or kick, experienced by a user. Recoil is the backward kick or force produced by a firearm upon discharge. During use, a user will place the butt-stock, also known as the butt of the gun, firmly against their shoulder to fire the weapon. Many rifles and shotguns have such a strong recoil, that a user's arm will become sore and may even experience bruising. Because of this recoil effect, the ability to fire multiple rounds accurately may be reduced, as well as the user's desire. Other users may even abstain from firing some weapons because of the recoil experienced. The present invention seeks to solve these problems.

SUMMARY OF EXAMPLE EMBODIMENTS

In one embodiment, a firearm recoil suppressor comprises a boot for receiving the butt-stock, at least one means for suppressing the recoil, a base, and a base fixture device. In one embodiment, the suppressing means comprises at least one hydraulic shock absorber, such as a piston and cylinder, or other shock absorber known to those with skill in the art.

In another embodiment, a firearm recoil suppressor may also comprise a barrel holder, an adjustable length base, and a plurality of suppressing means.

DETAILED DESCRIPTION OF EXAMPLE EMBODIMENTS

The following descriptions depict only example embodiments and are not to be considered limiting of its scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

Figure 1A:
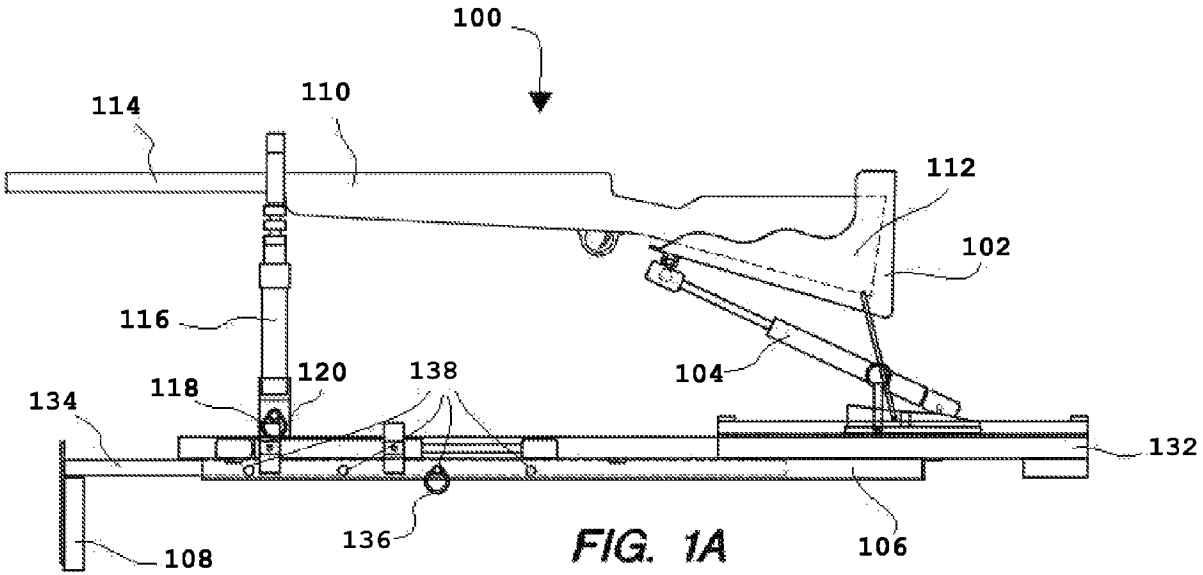
FIG. 1A is a side view of a firearm recoil suppressor in an un-fired position

In general, as illustrated in FIG. 1A, a firearm recoil suppressor 100 comprises a boot 102 for receiving the butt-stock 112, at least one means 104 for suppressing the recoil, a base 106, and a base fixture device 108. While boot 102 is shown as receiving the butt-stock 112 of a long-barrel firearm 110, boot 102 may also be adapted to receive the pistol grip of a pistol. It will be appreciated that the materials made to manufacture the invention may be of several types. For example, the boot 102 may be comprised of plastics, rubbers, leathers, or any number of suitable materials. The base 106 is preferably constructed of substantially rigid materials, such as metals, woods, hard plastics, or their equivalents. In one embodiment, the suppressing means 104 comprises at least one hydraulic shock absorber, such as a piston and cylinder, or other shock absorber known to those with skill in the art; this includes the use of coil springs, although the effectiveness may be somewhat reduced by the recoil of the spring. As shown in FIG. 1A, a firearm 110 is positioned with the butt-stock 112 in the boot 102. In one embodiment, the barrel 114 is placed in barrel holder 116. Barrel holder 116 may be rotatable, collapsible, and/or removable and may likewise be made from metals, plastics, or woods. Barrel holder 116 may also comprise a stability plate 118 to prevent inadvertent collapsing. Locking mechanism 120 allows for barrel holder 116 to be removable should the user desire. Locking mechanism 120 may comprise a nut and bolt, locking pin, cotter-pin, spring-loaded pins, or other removable locking means known to those with skill in the art.

For example, a user will place firearm recoil suppressor 100 on a shooting stand with the barrel holder 116 on the distal end. Base fixture device 108 hangs in front of the stand, where a user will then pull the recoil suppressor toward him/ her so that the base fixture device 108 is proximal to the stand, thereby engaging it. The base fixture device 108 may be a flat surface, or with spikes as further outlined herein, which aids in keeping the recoil suppressor 100 from moving during use. Once secured in place, a user will then place a firearm in the boot 102 and may or may not use barrel holder 116.

Figure 1B:
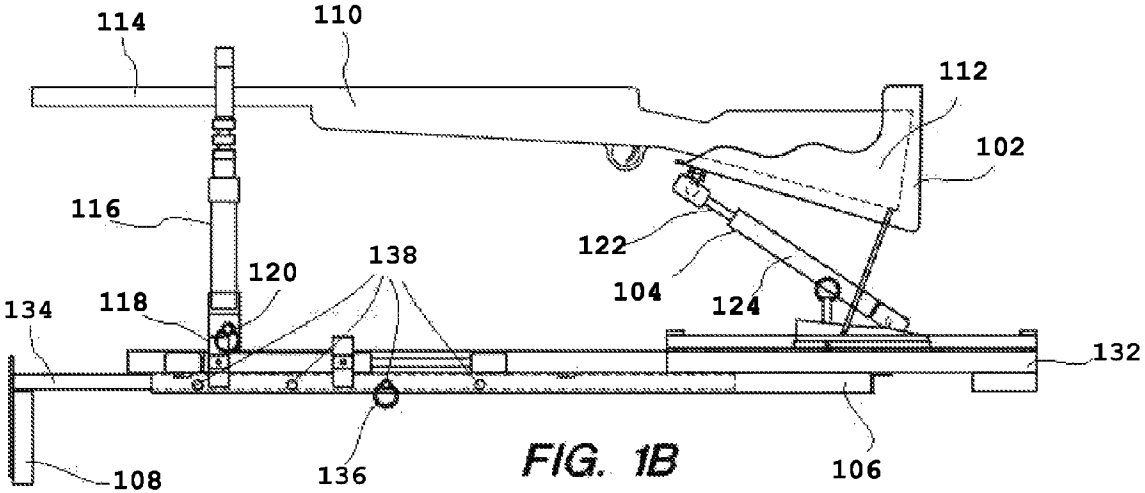
FIG. 1B is a side view of a firearm recoil suppressor in the recoiled position

As shown in FIG. 1B, once a firearm 110 is discharged, suppressing means 104 absorbs the recoil. As shown in FIG. 1B, suppressing means 104 may comprise a piston 122 and cylinder 124, or any other shock absorber, such as spring actuated shock absorbers, compression absorbers, or others known to those with skill in the art. It will be understood that although barrel holder 116 is shown in conjunction with firearm 110 in the discharged position, a user may use recoil suppressor 100 without barrel holder 116 by simply collapsing it, as can be seen in FIGS. 2A and 2B, or by removing it by releasing locking means 120.

Base fixture device 108 comprises at least one means for securing the base fixture device to a shooting stand or bench. For example, the securing means of base fixture device 108 may comprise at least one nut and bolt, at least one nail or other spike, or a plurality of spikes so that base 106 remains grounded to the shooting stand or bench. Base fixture device 108 is generally perpendicular to base 106, but may also be rotatable and/or removable for storage and transportation purposes. Base fixture device should generally not extend beyond a ninety-degree angle with base 106 and is generally comprised of strong materials, such as wood, metals, or hard plastics that can withstand the recoil force when a weapon is fired. Further, should base fixture device comprise spikes or similar, they extend toward a user in a generally parallel fashion so as to be able to engage a table or shooting stand.

Figure 2A:
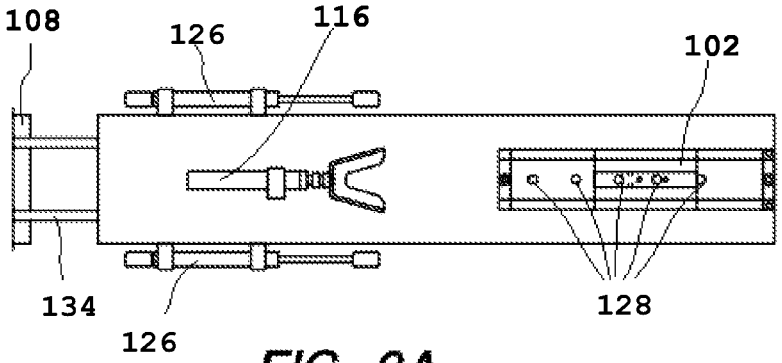
FIG. 2A is a top view of a firearm recoil suppressor in the collapsed position
Figure 2B:
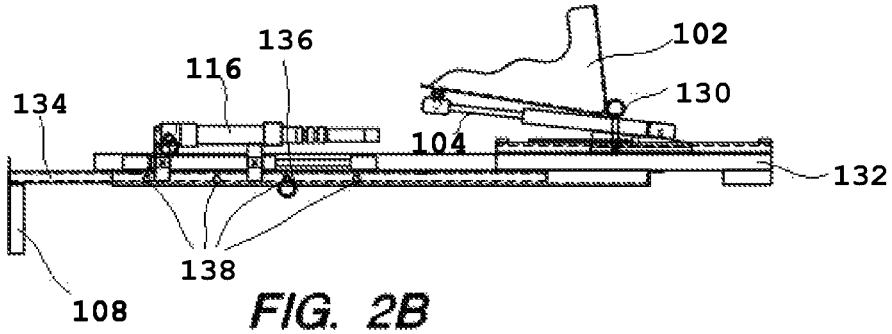
FIG. 2B is a side view of a firearm recoil suppressor in the collapsed position
Figure 2C:
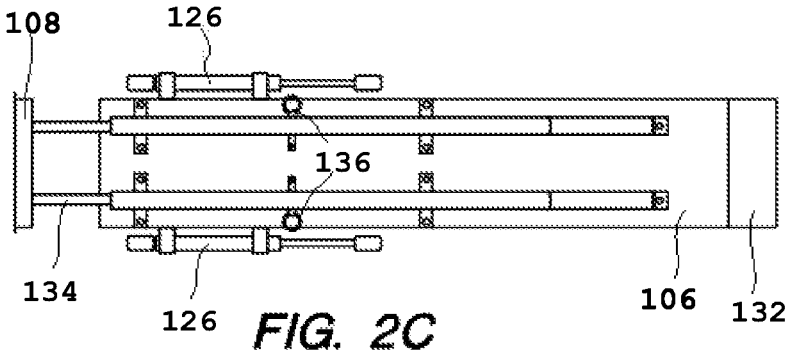
FIG. 2C is a bottom view of a firearm recoil suppressor

In one embodiment, as seen in FIG. 2A, additional suppressing means 126 further reduce the recoil felt by the user. Like suppressing means 104, additional suppressing means 126 may be comprised of a piston and cylinder, or any other shock absorber, such as spring actuated shock absorbers, compression absorbers, or others known to those with skill in the art. Boot plate adjustment slots 128 secure the boot 102 in the desired position with locking means 130 (shown in FIG. 2B). Locking means 130 may comprise nut and bolt, locking pin, cotter-pins, spring-loaded pins, or other means known to those with skill in the art. As further shown in FIG. 2B, boot 102 may also be collapsible for easier storage, and may also be removed. Boot 102 may be horizontally adjusted by sliding the boot plate 132 on base 106.

As shown in FIGS. 1A-2C, base fixture device 108 may be horizontally adjusted by sliding adjusting rods 134 and securing them in place with rod securing means 136. Rod securing means 136 may comprise nut and bolt, locking pin, cotter-pins, spring-loaded pins, or other means known to those with skill in the art, in conjunction with rod adjustment slots 138. It will be appreciated that adjusting rods 134 may be telescopic rods, tongue and groove, base and plate sliding, or any other extendable method known to those of skill in the art.

Figure 3A:
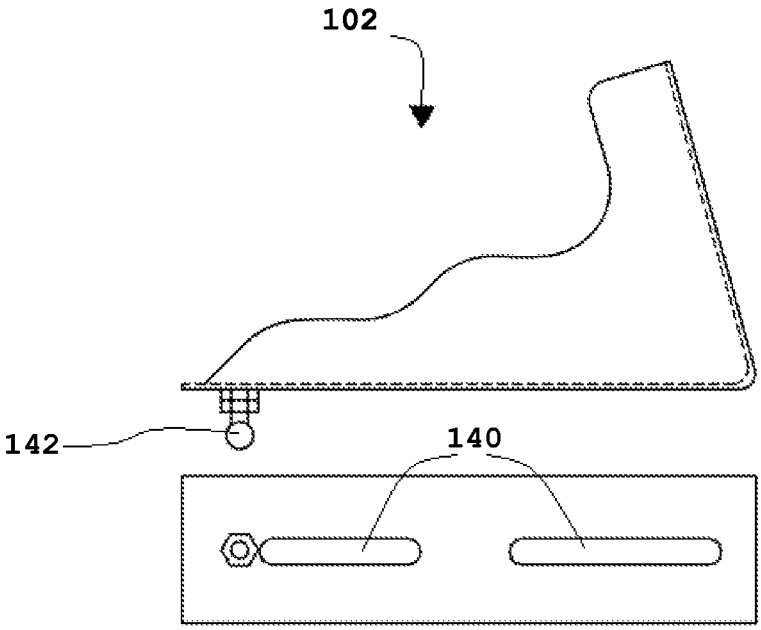
FIG. 3A is a side and bottom view of the butt-stock holder

In yet another embodiment, as illustrated in FIG. 3A, boot 102 may comprise contours or spaces 140 to allow accessories (e.g., shoulder strap) connected to the butt-stock to remain connected without interfering with the boot 102. Connecting means 142 allows the boot to be removably attachable to suppressing means 104. Connecting means 142 may comprise a nut and bolt, locking pin, or other means known to those of skill in the art.

Figure 3B:
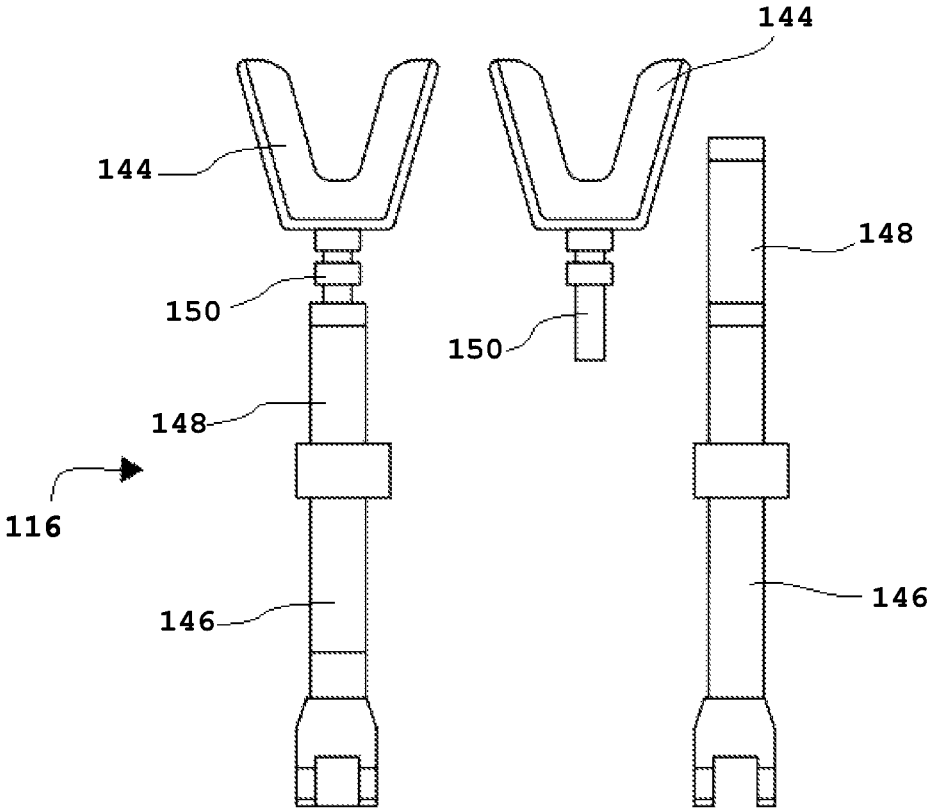
FIG. 3B is a front view of the barrel holder

In another embodiment, as shown in FIG. 3B, barrel holder 116 comprises cradle 144, arm 146, and extension portion 148. Extension portion 148 allows a user to adjust the height of barrel holder 116 to the desired position. Extension portion 148 may comprise threaded tubing, locking pins, or other mechanisms so as to adjust the height thereof. In one embodiment, cradle 144 is adjustable via second extension portion 150 and may also be removable from barrel holder 116.

A method of reducing the recoil experienced by a user, the method comprising using a base attachable to a shooting stand, bench, or other sturdy resting place, a means of securing the base to the stand, a boot portion for receiving the butt-stock of a firearm, at least one suppressing means, and firing a firearm from said device.

What is claimed is:

1. A firearm recoil suppressor, comprising:

a base having a base fixture device at a first end and a boot plate at a second end, wherein the base fixture device is extendably coupled to the base using adjusting rods and wherein the boot plate is slidably coupled to the base;

a piston and cylinder shock absorber removably attachable to the boot plate and extending upwardly where it is removably attachable to a boot;

wherein the base fixture device is substantially perpendicular to the base for engaging a surface to prevent the base from moving during use; and a collapsible barrel holder.

2. The firearm recoil suppressor of claim 1, wherein the base fixture device comprises at least one spike or nail protruding from the base fixture device in a generally horizontal manner for engaging a surface.

3. The firearm recoil suppressor of claim 1, wherein the boot is adapted for pistol grips.

4. The firearm recoil suppressor of claim 1, wherein the boot is collapsible.

5. The firearm recoil suppressor of claim 1, wherein the boot is removable.

6. The firearm recoil suppressor of claim 1, wherein the boot height-adjustable.

7. The firearm recoil suppressor of claim 1, wherein the barrel-holder is removable.

8. The firearm recoil suppressor of claim 1, wherein the barrel-holder is height adjustable.

9. A method using the firearm recoil suppressor of claim 1 to reduce the recoil experienced by a user, the method comprising:

placing the firearm recoil suppressor on a surface with the base fixture device extending downward in a substantially perpendicular manner in front of the surface and pulling the firearm recoil suppressor toward a user until the base fixture device engages the front of the surface;

placing the butt-stock or pistol grip in the boot of the firearm recoil suppressor; and firing the firearm.

10. The method of claim 9 comprising a user placing the barrel of a gun in the collapsible barrel holder.

* * * * *